US008146674B2

(12) United States Patent
Lee

(10) Patent No.: US 8,146,674 B2
(45) Date of Patent: Apr. 3, 2012

(54) APPARATUS FOR STORING HAZARDOUS MATERIAL

(75) Inventor: Yeu Yong Lee, Seoul (KR)

(73) Assignee: Chang Sung Ace Co., Ltd., Seongnam-Si, Gyeonggi-Do (KR)

( * ) Notice: Subject to any disclaimer, the term of this patent is extended or adjusted under 35 U.S.C. 154(b) by 231 days.

(21) Appl. No.: 12/731,815

(22) Filed: Mar. 25, 2010

(65) Prior Publication Data

US 2011/0234058 A1 Sep. 29, 2011

(51) Int. Cl.

| | |
|---|---|
| ***A62C 37/36*** | (2006.01) |
| ***A62C 35/00*** | (2006.01) |
| ***A62C 3/06*** | (2006.01) |
| ***A62C 3/00*** | (2006.01) |
| ***A47B 97/00*** | (2006.01) |
| ***B65D 21/02*** | (2006.01) |

(52) U.S. Cl. ..... 169/61; 169/11; 169/48; 169/49; 312/215; 312/229; 312/291; 220/23.87; 220/23.88

(58) Field of Classification Search ..... 169/11, 169/48, 49, 51, 60, 61, 66, 68; 312/31, 31.1, 312/114, 117, 119, 122, 138.1, 215, 229, 312/234.1, 237, 291, 317.1, 317.3, 352, 409; 220/1.5, 23.87, 23.88, 580; 588/259–261
See application file for complete search history.

(56) References Cited

U.S. PATENT DOCUMENTS

| | | | | |
|---|---|---|---|---|
| 5,254,798 | A * | 10/1993 | Zoback | 588/259 |
| 5,356,206 | A * | 10/1994 | Van Valkenburgh | 312/317.1 |
| 5,511,908 | A * | 4/1996 | Van Valkenburgh et al. | 405/129.55 |
| 5,785,591 | A * | 7/1998 | Payne | 454/118 |
| 5,813,739 | A * | 9/1998 | White | 312/409 |
| 5,944,399 | A * | 8/1999 | Gillispie | 312/324 |
| 6,155,747 | A * | 12/2000 | Payne et al. | 405/129.55 |
| 6,179,522 | B1 * | 1/2001 | Sanford et al. | 405/129.55 |
| 6,305,131 | B1 * | 10/2001 | Romig | 52/79.1 |
| 6,578,639 | B1 * | 6/2003 | Osime et al. | 169/68 |
| 7,565,773 | B1 * | 7/2009 | Romig | 52/79.1 |
| 2003/0001465 | A1 * | 1/2003 | Carter et al. | 312/215 |
| 2009/0085447 | A1 * | 4/2009 | McLuckie et al. | 312/234.1 |
| 2009/0255694 | A1 * | 10/2009 | Peltz et al. | 169/48 |

* cited by examiner

*Primary Examiner* — Darren W Gorman

(74) *Attorney, Agent, or Firm* — IPLA P.A.; James E. Bame

(57) ABSTRACT

Disclosed herein is an apparatus for storing hazardous material. The apparatus includes storage containers each of which stores a hazardous material storage box containing hazardous material. The hazardous material storage box is extracted from or retracted into the storage container by a transfer means. A fire sensor is provided in each storage container to detect a fire occurring in the storage container. A temperature sensor is provided in each storage container to sense a temperature in the storage container. An injection nozzle is provided in each storage container. The injection nozzle injects nitrogen into the storage container from a nitrogen supply unit when a fire is detected. An outlet pipe connection passage and a flexible outlet pipe connection tube are provided to exhaust gas from the storage containers. A collecting container is provided in the lower end of the apparatus to collect and store leakage liquid of hazardous material.

6 Claims, 13 Drawing Sheets

APPARATUS FOR STORING HAZARDOUS MATERIAL

BACKGROUND OF THE INVENTION

1. Technical Field

The present invention relates generally to apparatuses for storing hazardous material. Here, the term "hazardous material" means material which must be reliably stored under special circumferences, such as a semiconductor factory, and may explode when it is exposed to the air. In particular, the present invention relates to an apparatus for storing hazardous material which is configured such that hazardous material is prevented from being exposed to the air, and even if some hazardous material is exposed to the air, it is slowly burned spontaneously; and when a fire occurs, it is rapidly extinguished.

2. Description of the Related Art

The present invention relates to apparatuses for storing hazardous material.

There are techniques of storing chemicals or hazardous materials which are used to manufacture wafers in semiconductor factories or of storing radioactive material storage containers in underground storehouses to prevent leakage of radioactivity.

An example of techniques pertaining to the present invention was proposed in Korean Utility Model Registration No. 20-0174138 entitled "Equipment for drying and storing cereals." In this conventional art, a technique for storing cereals in a storage tank and controlling the temperature in the storage tank was disclosed.

Furthermore, a device for storing articles for a drawer type refrigerator was proposed in Korean Patent Registration No. 10-0540076. However, a technique for storing or protecting hazardous material was not proposed.

To date, apparatuses for storing hazardous material which are installed in semiconductor factories typically have reception structures. Therefore, if chemicals or hazardous materials are exposed to the air, a fire may occur, toxic material may be emitted, or it may explode, resulting in damage to equipment or injury to humans.

In addition, in these conventional techniques, because systems for storing hazardous chemicals are not reliable, there is a likelihood for a dangerous accident to occur.

SUMMARY OF THE INVENTION

Accordingly, the present invention has been made keeping in mind the above problems occurring in the prior art, and an object of the present invention is to provide an apparatus for storing hazardous material which is configured such that when spontaneous combustible hazardous material is exposed to the air, it slowly burns spontaneously, and when a fire occurs, it can be rapidly extinguished.

Another object of the present invention is to provide an apparatus for storing hazardous material which can safely store hazardous material, allows an administrator to easily observe the interior conditions, can be controlled by a computer system, and can detect a fire and extinguish it.

A further object of the present invention is to provide an apparatus for storing hazardous material which is constructed such that hazardous material is prevented from being exposed to the air, and when a fire occurs, can rapidly detect the fire and automatically extinguish the fire.

Yet another object of the present invention is to provide an apparatus for storing hazardous material in which when a fire occurs, a door of a storage container storing hazardous material therein is automatically closed such that the fire can be rapidly extinguished.

In order to accomplish the above object, the present invention provides an apparatus for storing hazardous material, including: a plurality of storage containers each storing a hazardous material storage box containing hazardous material therein, the hazardous material storage box being extracted from or retracted into the storage container by transfer means; a fire sensor provided in each of the storage containers to detect a fire occurring in the storage container; a temperature sensor provided in each of the storage containers to sense a temperature in the storage container; an injection nozzle provided in each of the storage containers, the injection nozzle injecting nitrogen into the storage container from a nitrogen supply unit when a fire is detected; an outlet pipe connection passage and a flexible outlet pipe connection tube to exhaust gas from the storage containers; and a collecting container provided in a lower end of the apparatus to collect and store leakage liquid of hazardous material therein.

Furthermore, a lock and a transparent fireproof window may be provided on each of the storage containers.

To prevent the hazardous material from leaking from the hazardous material storage box, the hazardous material storage box may be configured such that a top plate is perpendicularly coupled to support plates by coupling bolts, and an inner reinforcing plate may be attached to each of the support plates by welding, with a cable hole formed in each of the support plates so that an electric wire or a cable passes through the cable hole.

In addition, a ventilation port may be provided in an outer wall of each of the storage containers so that gas is discharged from the storage container through the ventilation port. The ventilation port may include: a square frame; one or more horizontal grid plates supported by the square frame, each of the horizontal grid plates having a plurality of horizontal ventilation slots; and one or more vertical grid plates supported by the square frame, each of the vertical grid plates having a plurality of vertical ventilation slots. The horizontal grid plates and the vertical grid plates may alternately overlap each other such that the vertical ventilation slots and the horizontal ventilation slots perpendicularly cross each other, thus forming a lattice structure.

The apparatus may further include: an outlet pipe through which gas is discharged from the storage containers; a lock provided on an outer surface of each of the storage containers to prevent an access of an unauthorized person; and an air curtain device provided in each of the storage containers to isolate an interior of the storage container from an outside air when the storage container is opened or a fire occurs in the storage container. Electrical devices for temperature control, ventilation and fire extinguishment may be installed in the storage containers. The electrical devices may comprise a control unit, a power supply, an earth leakage breaker, a DC power supply unit, a programmable logic controller (PLC) and a relay.

The apparatus may further include a door control cylinder and a solenoid valve connected to each of the storage containers.

When the fire sensor determines that a fire occurs in the storage container, the solenoid valve may be turned on such that the nitrogen supply unit supplies nitrogen into the door control cylinder. When the fire sensor determines that the fire is extinguished in the storage container, the solenoid valve may be turned off such that a nitrogen discharge path along which the nitrogen is discharged from the door control cylinder is formed.

The door control cylinder may have: an inlet through which the nitrogen is supplied from the nitrogen supply unit into the door control cylinder; an outlet through which air is discharged outside of the door control cylinder; a cylinder rod rotatably coupled to a connection arm, the connection arm being rotatably coupled to a door of the storage container, the cylinder rod being operated by the nitrogen supplied into the door control cylinder; and a piston coupled to a corresponding end of the cylinder rod in the door control cylinder. The inlet is formed in the door control cylinder at a side adjacent to the cylinder rod based on the piston, and the outlet is formed in the door control cylinder at a side opposite to the cylinder rod based on the piston.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF SPECIFIC EMBODIMENTS

Hereinafter, an apparatus for storing hazardous material according to a preferred embodiment of the present invention will be described in detail with reference to the attached drawings.

Figure 1:
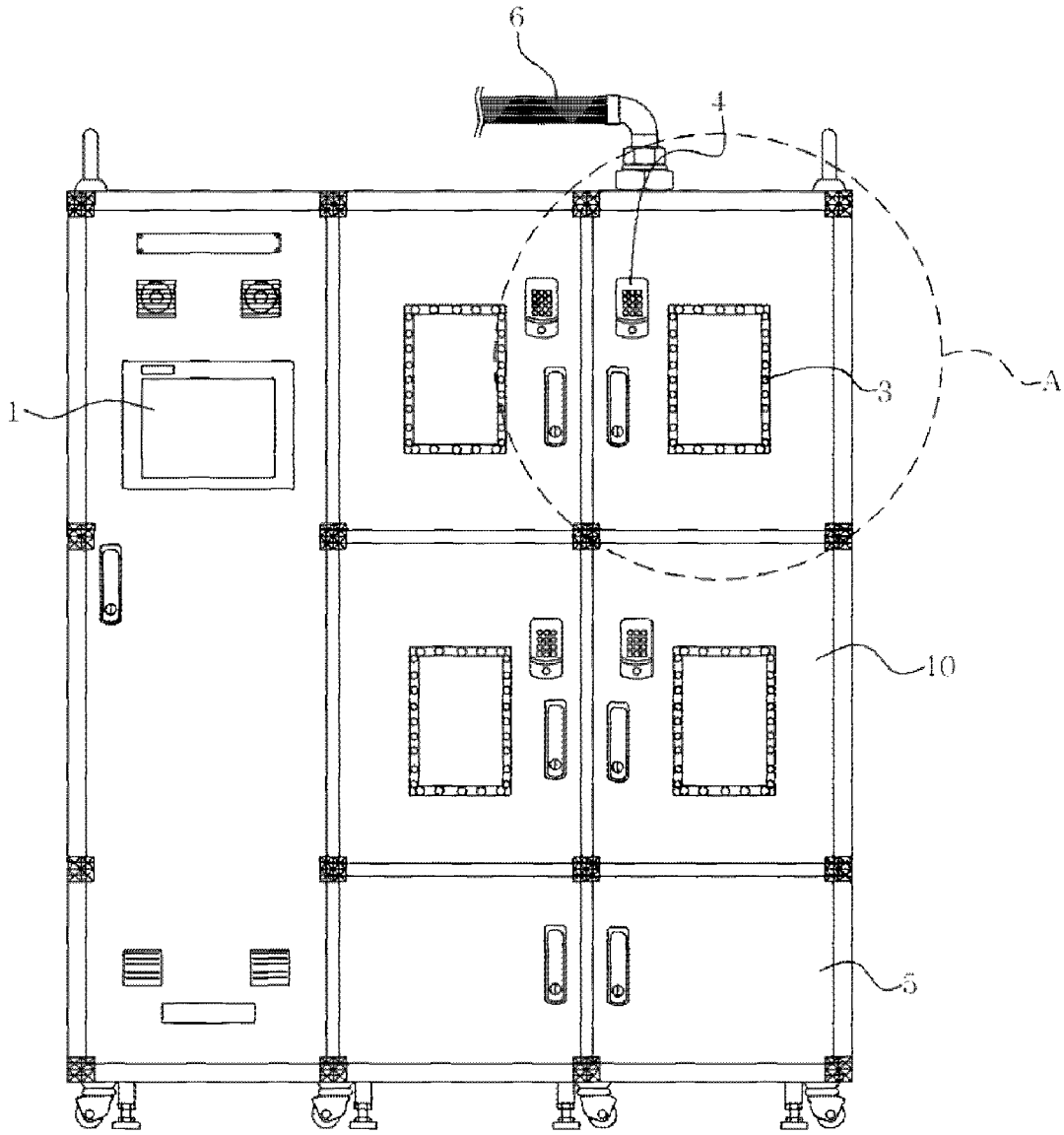
FIG. 1 is a front view illustrating an apparatus for storing hazardous material, according to an embodiment of the present invention.
Figure 2:
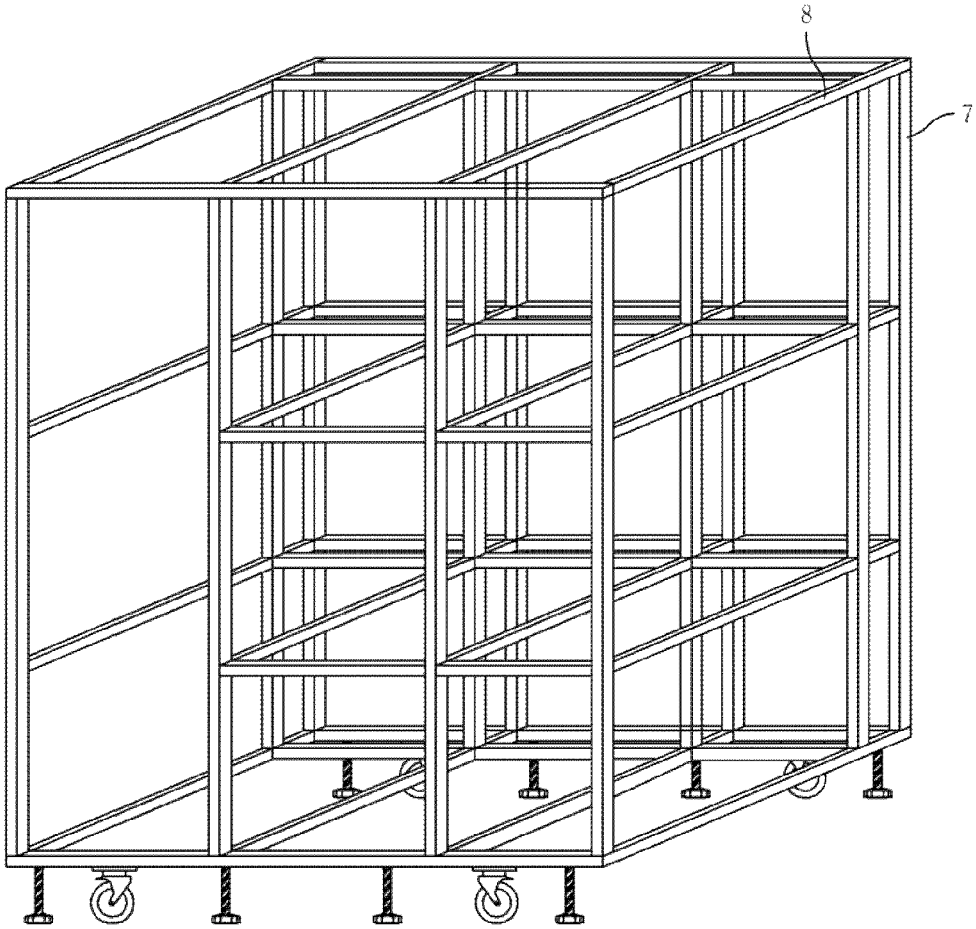
FIG. 2 is a perspective view showing the construction of a frame of the storage apparatus according to the present invention.
Figure 3:
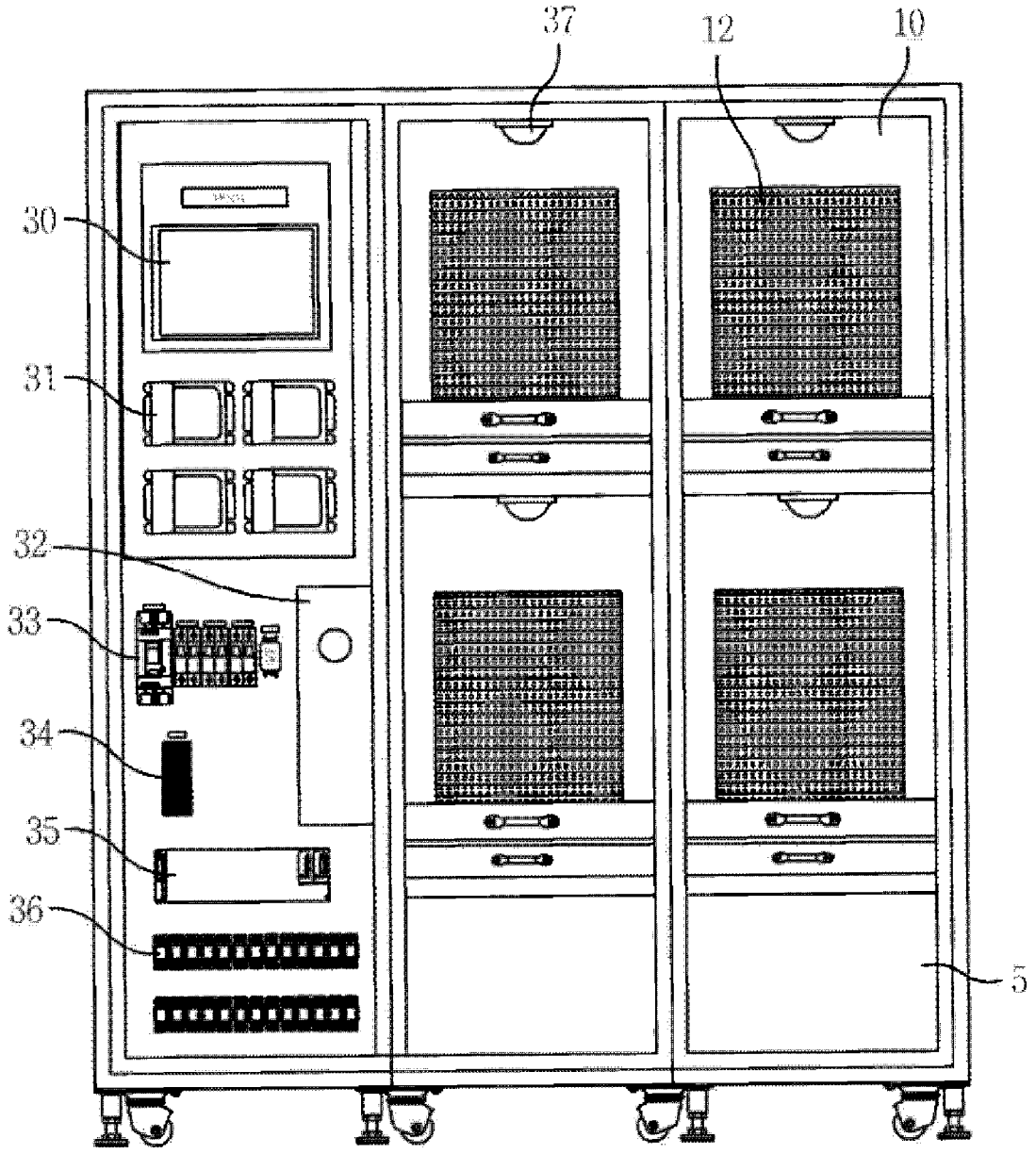
FIG. 3 is a front view illustrating the construction of the storage apparatus according to the present invention.
Figure 4:
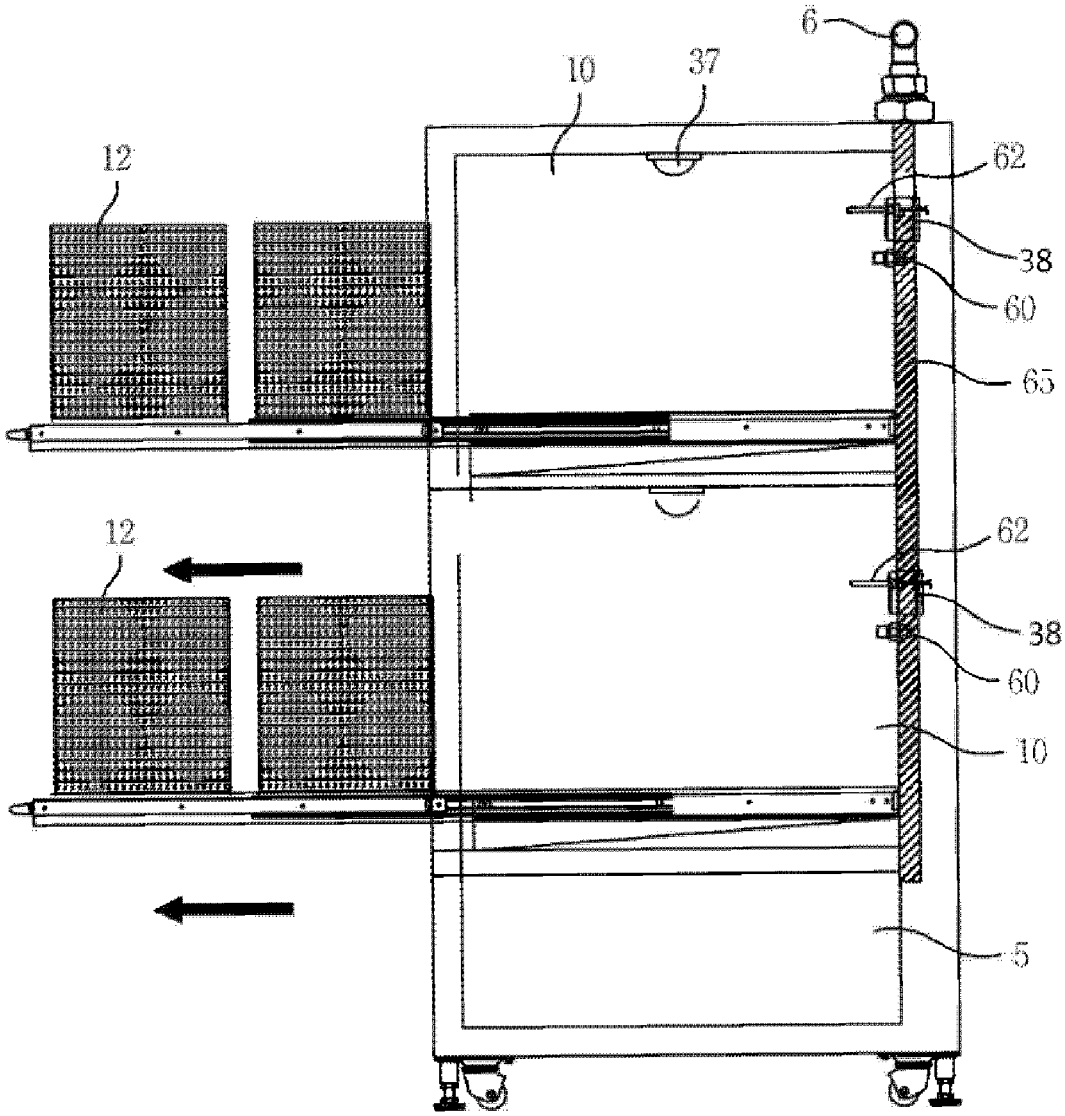
FIG. 4 is a side view showing the operation of the storage container according to the present invention.
Figure 5:
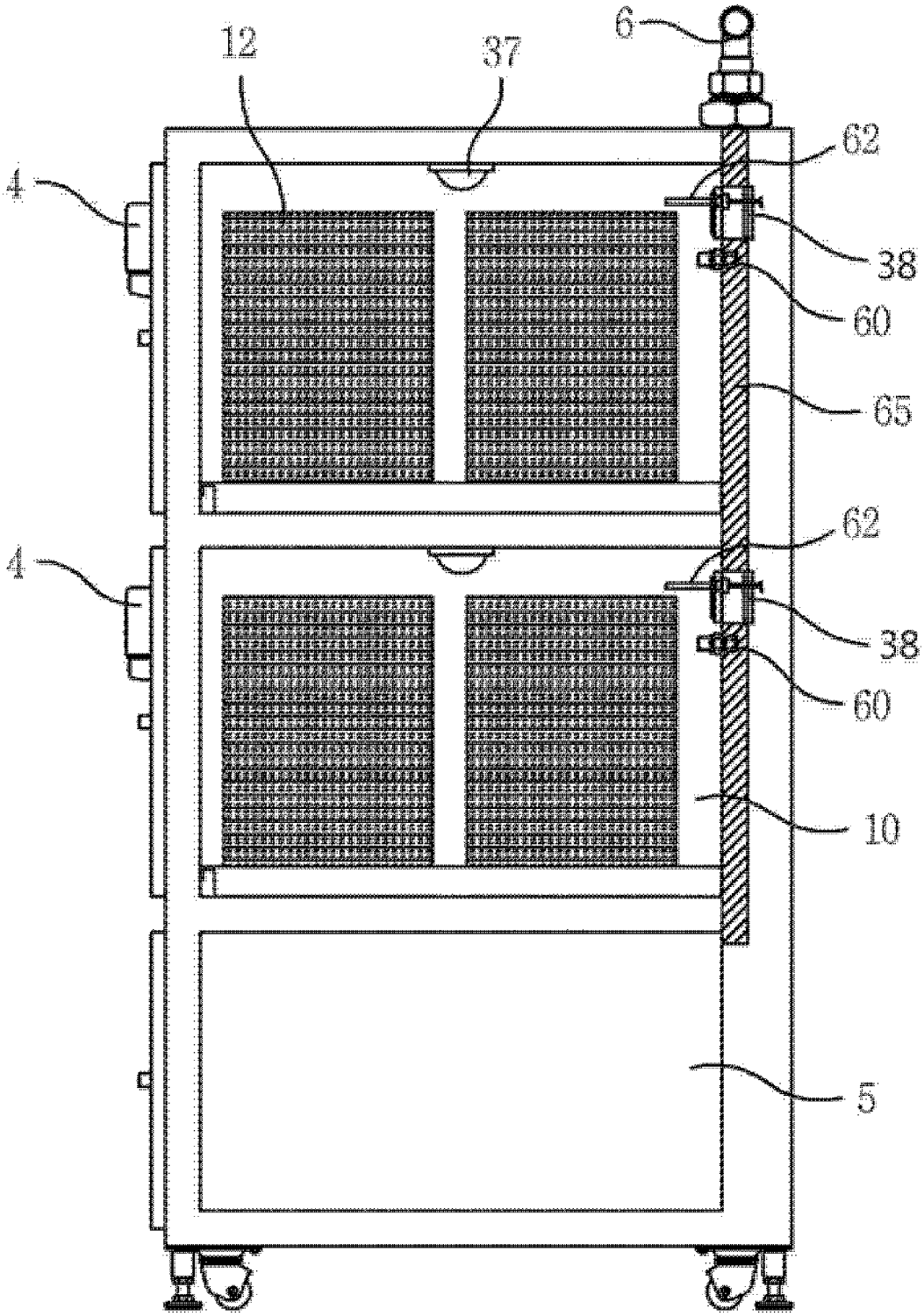
FIG. 5 is a side view showing an automatic fire extinguishing device provided in the storage container according to the present invention.
Figure 6:
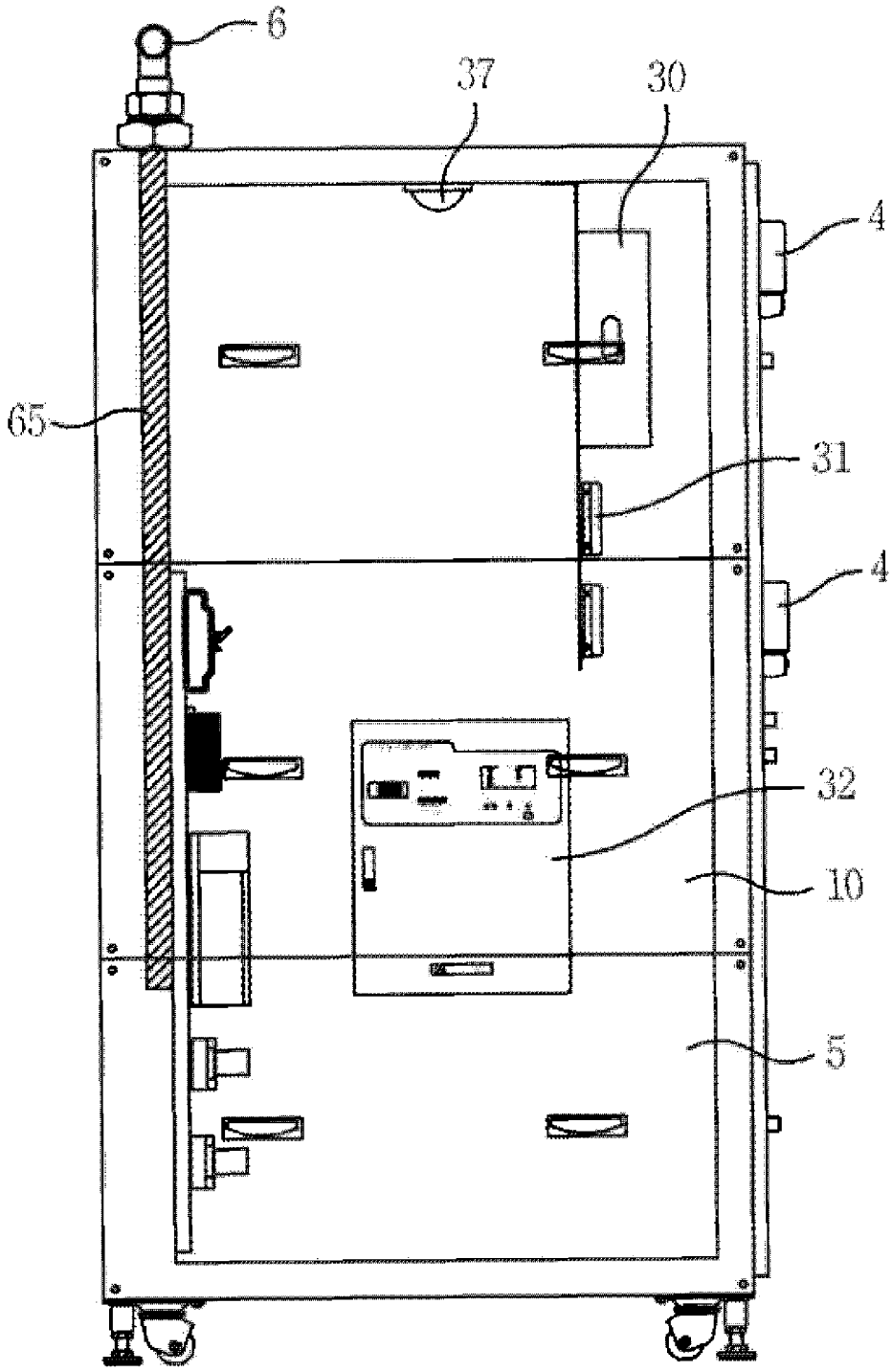
FIG. 6 is a side view showing the storage apparatus according to the present invention.
Figure 7:
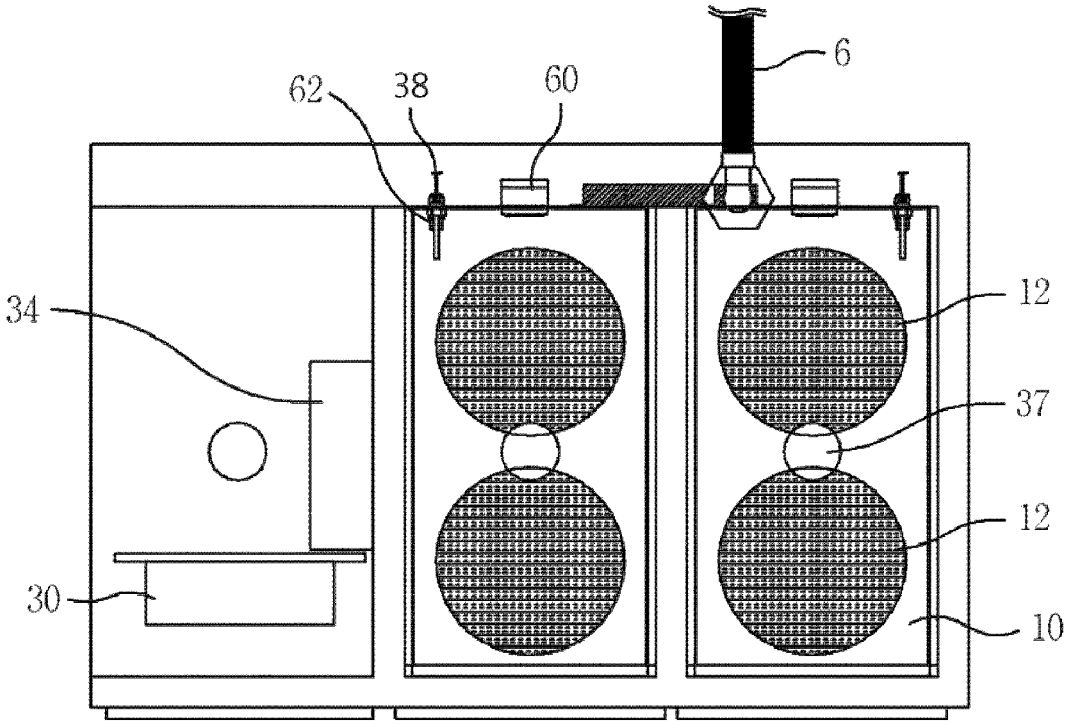
FIG. 7 is a plan view showing the storage apparatus according to the present invention.
Figure 8:
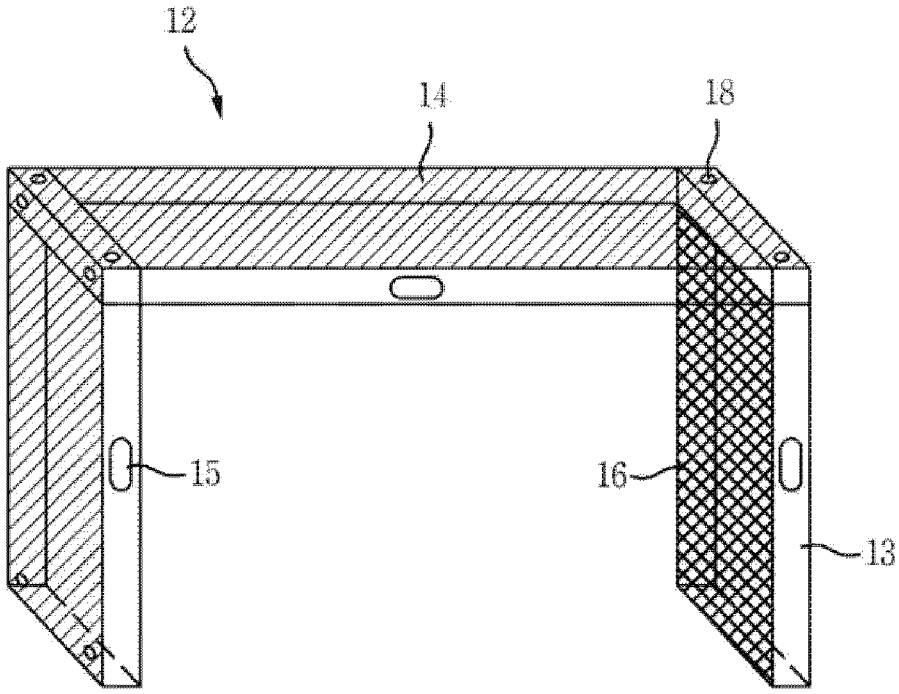
FIG. 8 is a perspective view showing an external wall of the hazardous material storage box according to the present invention.
Figure 9:
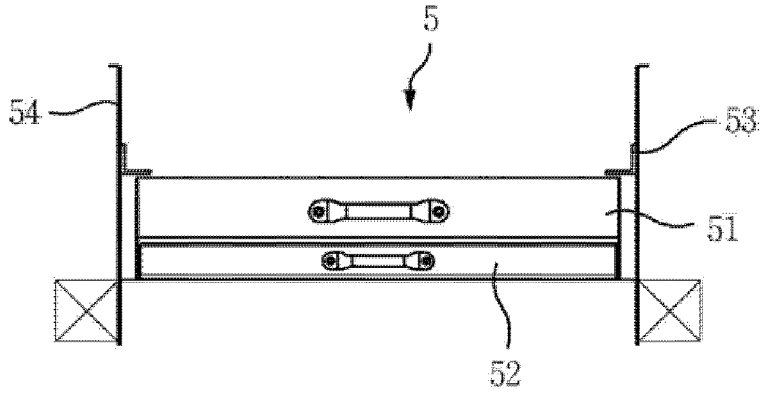
FIG. 9 is a front view showing a drawer structure of the collection container according to the present invention.
Figure 10:
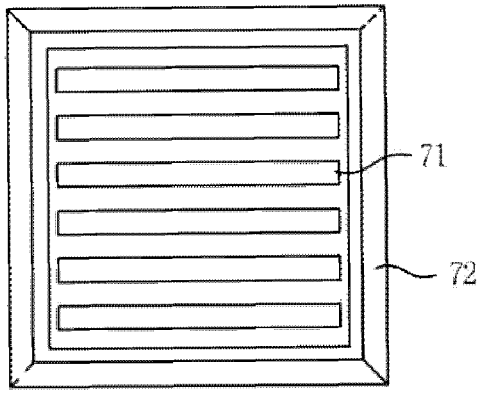
FIG. 10 is a front view showing a ventilation port of the storage container according to the present invention.
Figure 11:
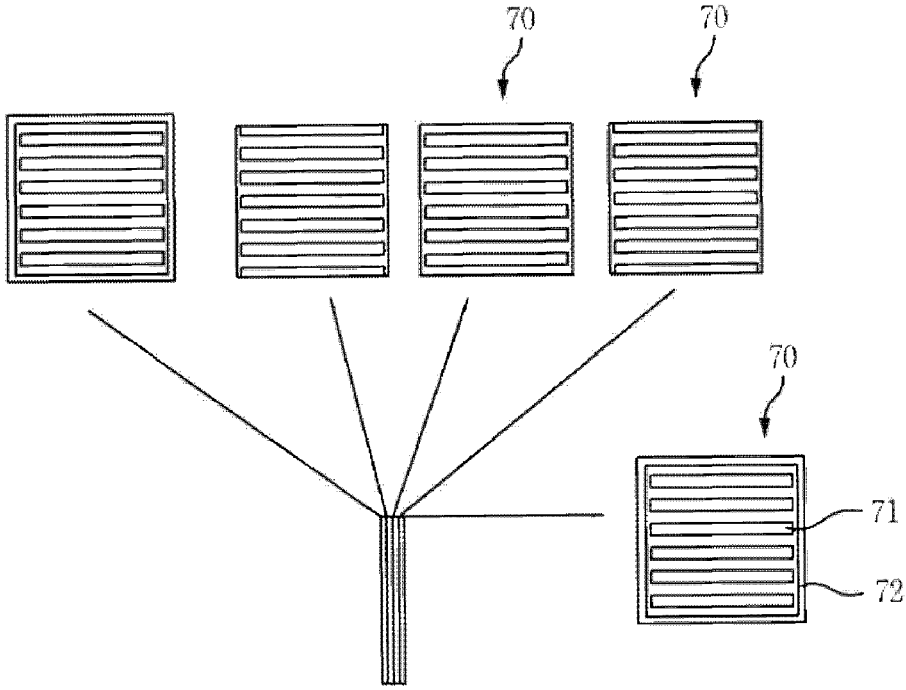
FIG. 11 is a view showing arrangement of ventilation ports of the storage containers according to the present invention.
Figure 12:
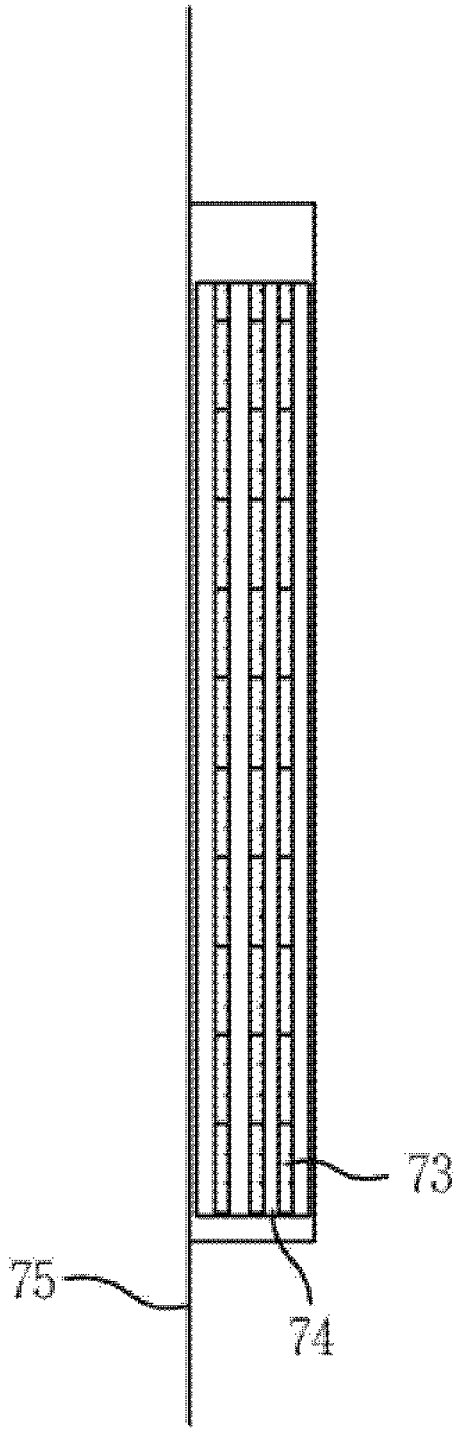
FIG. 12 is a sectional view showing the ventilation port of FIG. 11.

FIG. 1 is a front view illustrating an apparatus for storing hazardous material, according to the embodiment of the present invention. FIG. 2 is a perspective view showing the construction of a frame of the storage apparatus according to the present invention. FIG. 3 is a view illustrating the construction of the storage apparatus according to the present invention. FIG. 4 is a side view showing the operation of the storage container according to the present invention. FIG. 5 is a side view showing an automatic fire extinguishing device provided in the storage container according to the present invention. FIG. 6 is a side view showing the storage apparatus according to the present invention. FIG. 7 is a plan view showing the storage apparatus according to the present invention. FIG. 8 is a perspective view showing an external wall of the hazardous material storage box according to the present invention. FIG. 9 is a front view showing a drawer structure of the collection container. FIG. 10 is a front view showing a ventilation port of the storage container. FIG. 11 is a view showing arrangement of ventilation ports of the storage containers. FIG. 12 is a sectional view showing the ventilation port.

Figure 13:
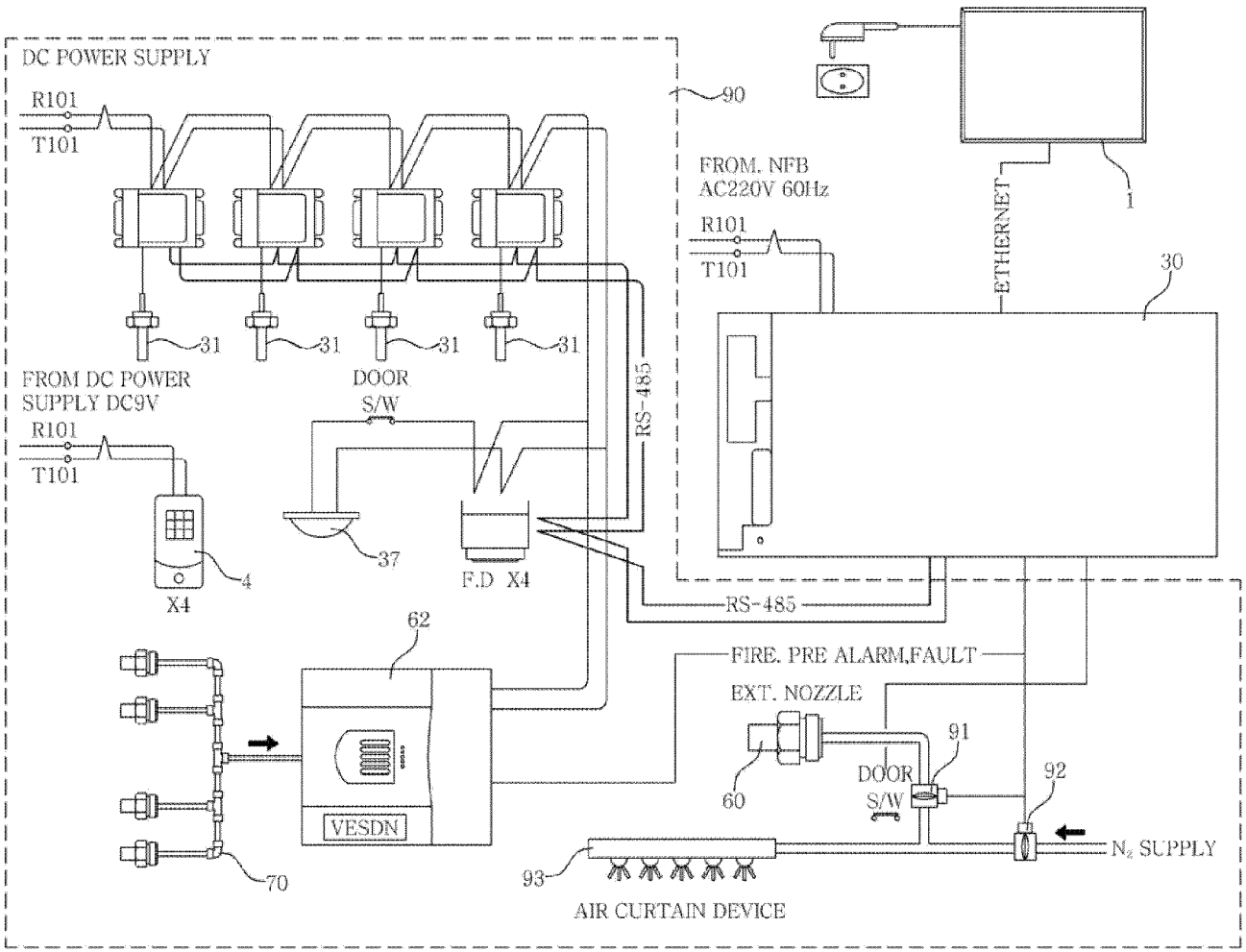
FIG. 13 is an electric distribution diagram of the automatic fire extinguishing device according to the present invention.
Figure 14:
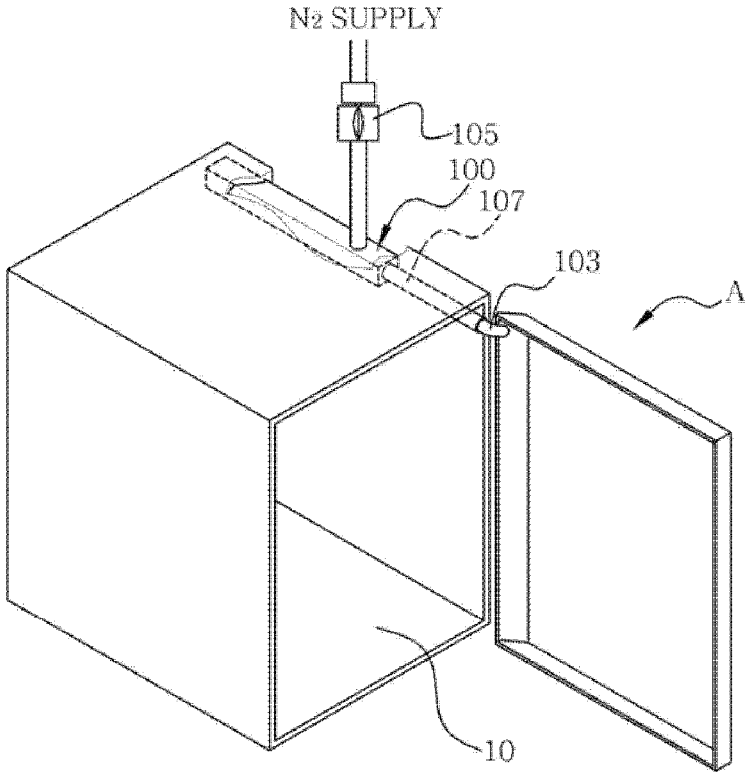
FIG. 14 is a perspective view illustrating the structure of the storage container according to the present invention.
Figure 15:
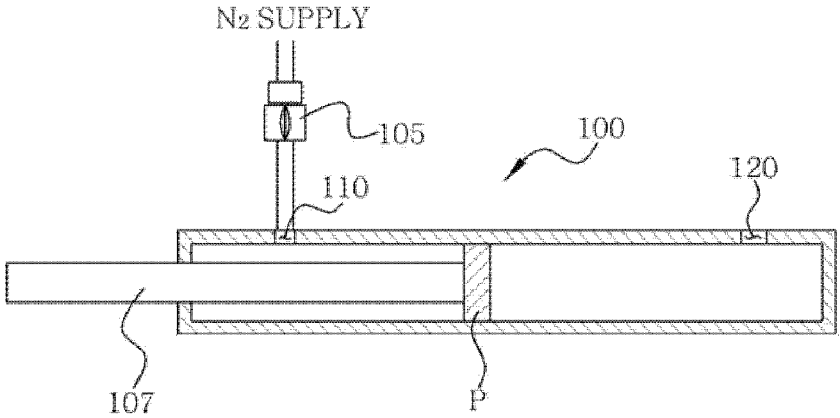
FIGS. 15 and 16 are views illustrating the operation of the door control cylinder when nitrogen is supplied thereinto according to the present invention.
Figure 16:
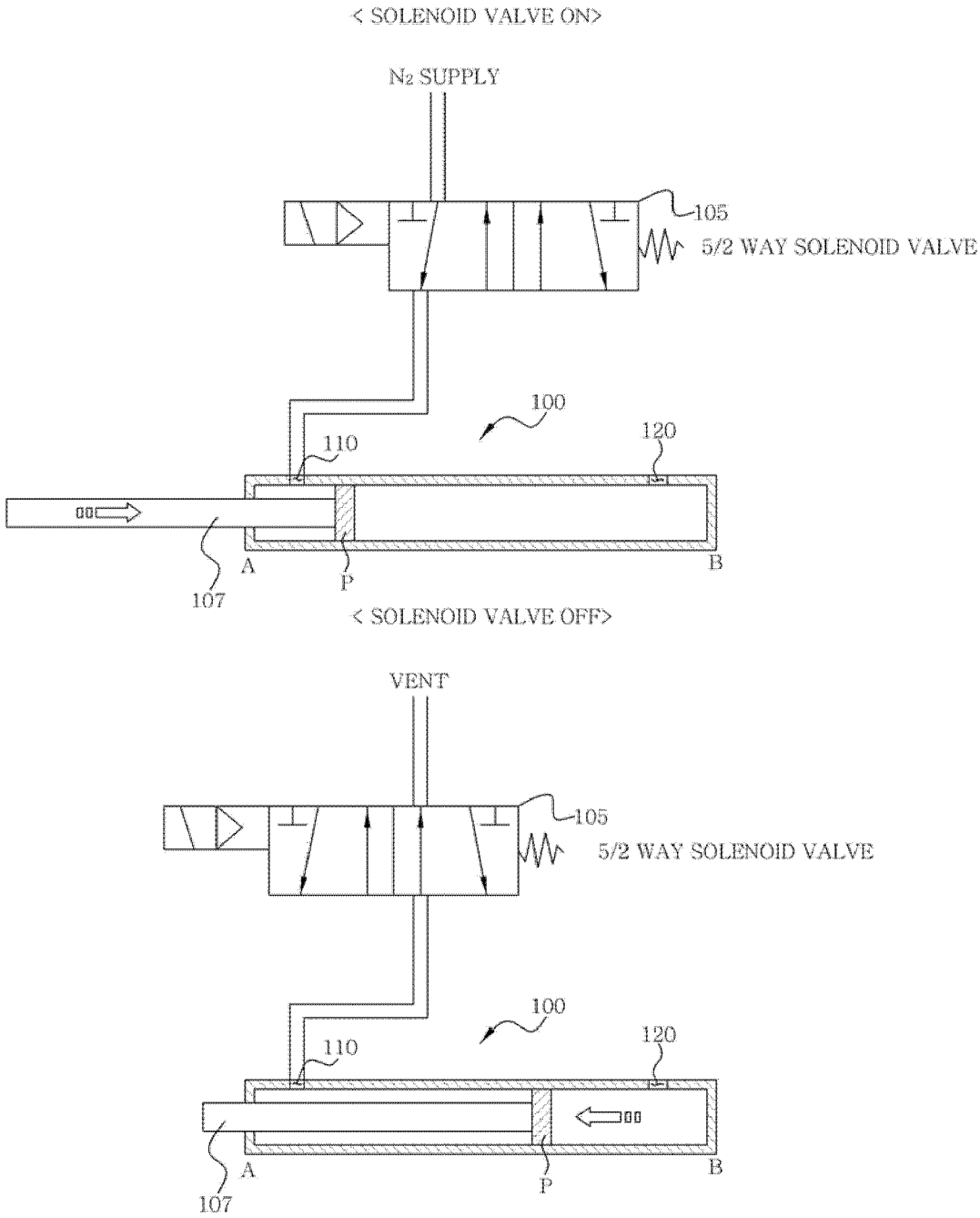

FIG. 13 is an electric distribution diagram of the automatic fire extinguishing device according to the present invention. FIG. 14 is a perspective view illustrating the structure of the storage container according to the present invention. FIGS. 15 and 16 are views illustrating the operation of the door control cylinder when nitrogen is supplied thereinto according to the present invention.

As shown in FIG. 1, in the storage apparatus according to the present invention, the storage containers 10 are installed in the frame. A collection container 5 is disposed below the storage containers 10. Furthermore, a touch screen monitor 1 is provided in a left portion of the front surface of the storage apparatus to enable an administrator to monitor the entire apparatus. A fireproof window 3 is provided on the front surface of each storage container 10 to allow the administrator to observe the interior conditions of the storage container 10 when necessary. In addition, electric devices, such as a power supply, an earth leakage breaker, etc., are installed in the storage apparatus. A gas exhaust pipe (not shown) is connected to the upper end of the storage apparatus so that gas is exhausted from the storage containers 10 through the gas exhaust pipe to prevent hazardous material from meeting air.

FIG. 2 is a perspective view showing the construction of the frame of the storage apparatus according to the present invention. As shown in FIG. 2, the frame of the storage apparatus is made of material such as steel or stainless steel, and includes a plurality of vertical frame bars 7 and a plurality of horizontal frame bars 8. The vertical frame bars 7 and the horizontal frame bars 8 are coupled to each other to form rectangular cells, such that the storage containers 10 can be independently installed in the rectangular cells.

FIG. 3 is a view illustrating the construction of the storage apparatus according to the present invention. In the storage apparatus according to the present invention, the storage containers 10 are installed in the right portion of the frame. Hazardous material storage boxes 12 are disposed in the storage containers 10. An interior lamp 37 is provided in each storage container 10. Furthermore, electric devices for controlling power and temperature in the storage containers 10 are installed in the left portion of the storage apparatus. The electric devices include, in positional sequence from the bottom to the top, a control unit 30, temperature controllers 31, a power supply 32, an earth leakage breaker 33, a DC power supply unit 34, a programmable logic controller (PLC) 35 and a relay 36.

FIG. 4 is a view showing extraction of the hazardous material storage boxes 12 from the storage containers 10. FIG. 5 is a view showing retraction of the hazardous material storage boxes 12 into the storage containers 10.

Referring to FIG. 4, in the present invention, when it is desired to replace or repair the hazardous material storage boxes 12 which have been in the storage containers 10, the administrator can easily extract the hazardous material storage boxes 12 from the storage containers 10. To achieve this purpose, each storage container 10 has a drawer structure. In addition, a pair of rails and a pair of sliders are provided in the lower portion of each storage container 10 as a transfer means. Thereby, the hazardous material storage boxes 12 can be easily extracted from or retracted into the storage containers 10 in a sliding drawer manner.

The interior lamp 37 is provided under the ceiling surface of each storage container 10. A fire sensor 38, a temperature sensor 62 and an injection nozzle 60 are provided on the sidewall of each storage container 10. An outlet pipe 65 is connected to the storage containers 10 to discharge gas from the storage containers 10. The outlet pipe 65 is connected to a flexible outlet pipe connection tube 6. When hazardous material ignites in the storage container 10, the injection nozzle 60 functions to rapidly extinguish the fire.

As shown in FIG. 5, one or more hazardous material storage boxes 12 can be stored in each storage container 10. Because each storage container 10 is operated in the sliding drawer manner, the hazardous material storage boxes 12 can be retracted only by pushing them such that the hazardous material storage boxes 12 are prevented from being exposed to the air. Therefore, the retraction of the hazardous material storage boxes 12 into the storage container 10 can be facilitated.

FIG. 6 is a side view showing the storage apparatus according to the present invention. As shown in FIG. 6, the storage containers 10 are supported by the frame including the vertical and horizontal frame bars 7 and 8. Each storage container 10 is configured in the unit of independent cell. In addition, the internal temperature of each storage container 10 can be controlled, and gas can be exhausted to the outside from the interior of the storage container 10. When a fire occurs in the storage container 10, the fire sensor 38 and the temperature sensor 62 detects the fire and the injection nozzle 60 automatically discharges fire extinguishing fluid, such as nitrogen. A lock 4 and the fireproof window 3 are provided on each storage container 10. The lock 4 prevents an unauthorized person from handling the hazardous material storage boxes 12. The fireproof window 3 enables the administrator to observe the interior of the storage container 10 when necessary.

FIG. 7 is a plan view showing the storage apparatus according to the present invention. As shown in FIG. 7, the hazardous material storage boxes 12 are stored in each storage container 10. Each storage container 10 has therein the fire sensor 38 which detects a fire, the temperature sensor 62 which senses the internal temperature and the injection nozzle 60 which extinguishes a fire. The flexible outlet pipe connection tube 6 is coupled to the storage apparatus to discharge gas from the storage containers 10.

Furthermore, the control unit 30 and the DC power supply unit 34 are connected to the storage containers 10.

FIG. 8 is a perspective view showing an external wall of the hazardous material storage box 12. As shown in FIG. 8, the hazardous material storage box 12 has the external wall which is made of double layered steel plates to prevent hazardous material from being exposed to the air. The external wall includes a pair of support plates 13 and a top plate 14 which is perpendicularly coupled to the support plates 13 by coupling bolts 18. Furthermore, an inner reinforcing plate 16 is attached to the inner surface of each support plate 13. Here, the inner reinforcing plate 16 is welded to the support plate 13 to tightly seal the interior of the hazardous material storage box 12. A cable hole 15 through which an electric wire or a cable passes is formed in each support plate 13.

FIG. 9 is a front view showing a drawer structure of the collection container 5. As shown in FIG. 9, the collection container 5 is provided below the storage containers 10. The collection container 5 functions to collect leakage liquid of hazardous material which may occur when the hazardous material storage boxes 12 are moved. The collection container 5 has a double drawer structure including an upper drawer 51 and a lower drawer 52. The upper and lower drawers 51 and 52 are reliably supported by support panels 53. Inclined sliding rails and a stopper are provided under each of the upper and lower drawers 51 and 52, so that when the administrator slides the upper or lower drawer 51 or 52, it can be easily opened or closed.

FIG. 10 is a front view showing a ventilation port 70 of the storage container 10. FIG. 11 is a view showing arrangement of ventilation ports 70 of the storage containers 10. FIG. 12 is a sectional view of the ventilation port 70. As shown in FIGS. 10 through 12, the ventilation port 70 is provided in an outer wall 75 of each storage container 10. The ventilation port 70 includes a square frame 72, a plurality of horizontal grid plates 73 and a plurality of vertical grid plates 74. Each horizontal grid plate 73 has a plurality of horizontal ventilation slots 71. Each vertical grid plate 74 has a plurality of vertical ventilation slots (not shown). The horizontal and vertical grid plates 73 and 74 are supported by the square frame 72 and alternately overlap each other such that the vertical ventilation slots and the horizontal ventilation slots 71 perpendicularly cross each other, thus forming a lattice structure. Thanks to this structure of the ventilation port 70, air can smoothly pass through the ventilation port 70 but flames generated by an explosion can be prevented from erupting to the outside through the ventilation port 70.

The ventilation port 70 of the present invention is designed such that internal gas is exhausted to the outside but a predetermined or greater amount of outside air is prevented from being drawn into the storage container 10. Thus, when spontaneous combustion hazardous material meets a predetermined amount of outside air, it can be slowly and spontaneously burned.

FIG. 13 is an electric distribution diagram of an automatic fire extinguishing device according to the present invention. As shown in FIG. 13, the hazardous material storage boxes 12 are stored in each storage container 10. Each storage container 10 has therein the fire sensor 38 which detects a fire, the temperature sensor 62 which senses the internal temperature and the injection nozzle 60 which extinguishes a fire. The storage containers 10 are connected to the control unit 30 and the DC power supply unit 34. In FIG. 13, the reference numeral 90 denoted by the dotted line means elements which are installed in each storage container 10. The temperature sensors 62 are connected to a DC power supply. The interior lamp 37, the ventilation port 70 and the fire sensor 38 are provided in each storage container 10. In addition, the injection nozzle 60 and an air curtain device 93 which isolates the internal air of the storage container 10 from the outside air are connected to an extinguishing fluid supply. The touch screen monitor 1 and the control unit 30 are provided outside the dotted-line portion 90.

In detail, when the temperature sensors 62 and the fire sensor 38 detects a fire, a communication/contact signal is inputted to the PLC 36. Then, a nitrogen nozzle alarm is outputted by a program of a calculation/interlock logic circuit. Thereby, a solenoid valve 91 connected to the injection nozzle 60 in the storage container 10 is turned on, so that extinguishing fluid, such as nitrogen, is injected into the storage container 10 from the injection nozzle 60, thus reducing the density of oxygen and extinguishing the fire.

Furthermore, when the storage container 10 is opened, the interior lamp 37 is turned on and a solenoid valve 92 connected to the air curtain device 93 is turned on so that nitrogen gas is discharged from the air curtain device 93 to protect the user from a flame or toxic gas.

In addition, when it is determined that a fire occurs in the storage container 10, the solenoid valve 92 connected to the air curtain device 93 is turned on so that nitrogen gas is discharged from the air curtain device 93 to isolate the interior of the storage container 10 from the outside air.

When necessary, the lock 4 is operated by a DC9V battery which can be used as an external power supply.

The control unit 30 monitors and controls variation and signals in the storage containers 10 and transmits all information to the touch screen monitor 1. The touch screen monitor 1 displays the control conditions, for example, such that trend data, an event alarm, door opening and the time at which hazardous material is extracted, etc. are displayed.

Meanwhile, the present invention is constructed such that when a fire occurs, the door of the storage container 10 is automatically closed to rapidly extinguish the fire. Hereinafter, a method of automatically closing the door of the storage container 10 when a fire occurs will be explained in detail with reference to FIGS. 14 through 16.

FIG. 14 is a perspective view showing the structure of portion A of FIG. 1. As shown in FIG. 14, the door of the storage container 10 is openably coupled to a body of the storage container 10 by a hinge (now shown). A door control cylinder 100 is provided at a predetermined position in the body of the storage container 10. A connection arm 103 of the storage container 10 is rotatably coupled at a first end thereof to a cylinder rod 107. A second end of the connection arm 103 is rotatably coupled to the door of the storage container 10.

FIGS. 15 and 16 are views illustrating the operation of the door control cylinder 100 when nitrogen is supplied thereinto.

A nitrogen supply unit ($N_2$SUPPLY), the door control cylinder 100 and a solenoid valve 105 are connected to each other to control the door of the storage container 10 such that when a fire occurs in the storage container 10, the door of the storage container 10 is closed.

In detail, when the fire sensor 38 determines that a fire occurs in the storage container 10, the solenoid valve 105 is operated to inject nitrogen into the door control cylinder 100 such that the cylinder rod 105 connected to the connection arm 103 of the storage container 10 is advanced to close the door of the storage container 10.

The door control cylinder 100 has an inlet 110 through which nitrogen is supplied from the nitrogen supply unit into the door control cylinder 100, and an outlet 120 through which air is discharged to the outside of the door control cylinder 100. The cylinder rod 107 is rotatably coupled to the connection arm 103 which is rotatably coupled to the door of the storage container 10. Furthermore, the cylinder rod 107 is moved in one direction depending on injection or discharge of nitrogen into or from the door control cylinder 100. A piston P is provided on the corresponding end of the cylinder rod 107 in the door control cylinder 100.

Here, the inlet 110 is formed in the door control cylinder 100 at a cylinder rod side based on the piston P. The outlet 120 is formed in the door control cylinder 100 at a side opposite to the cylinder rod based on the piston P. The piston P moves between the inlet 110 and the outlet 120. The solenoid valve 105 is connected to the inlet 110 so that nitrogen is injected from the nitrogen supply unit into the door control cylinder 100 or discharged from the door control cylinder 100 through the inlet 110. The outlet 120 communicates with the outside air.

In more detail, when the fire sensor 38 determines that a fire occurs in the storage container 10, the solenoid valve 105 is turned on. Then, the solenoid valve 105 moves a spool (not shown) such that nitrogen is injected into the door control cylinder 100 from the nitrogen supply unit ($N_2$SUPPLY). Thereby, nitrogen is injected into the door control cylinder 100 through the inlet 110. Thus, the cylinder rod 107 coupled to the connection arm 103 is retracted (in the direction from A towards B). As a result, the door of the storage container 10 is closed.

Furthermore, when the fire is extinguished in the storage container 10, the solenoid valve 105 is turned off. Then, the solenoid valve 105 moves the spool (not shown) such that the supply of nitrogen into the door control cylinder 100 is interrupted and a nitrogen discharge path along which the nitrogen is discharged from the door control cylinder 100 is formed.

In this case, because nitrogen pressure is no longer applied to the cylinder rod 107, the cylinder rod 107 can be moved forwards (in the direction from B towards A) to allow the door of the storage container 10 to be opened.

Typically, the solenoid valve functions to select the direction in which fluid, such as air or oil, flows so as to control the direction in which an actuator (for example, a cylinder) connected to the solenoid valve is operated. Generally, the solenoid valve is constructed such that fluid paths are selectively opened or closed by moving a spool in the main body having a plurality of ports through which fluid passes.

As described above, in an apparatus for storing hazardous material according to the present invention, one or more hazardous material storage boxes can be stored in each of a plurality of storage containers. Each storage container is operated in a drawer sliding manner so that exposure of hazardous material to the air can be restrained and the handling thereof can be facilitated.

Furthermore, in the present invention, an administrator can monitor and observe the conditions of the hazardous material stored in the storage containers through a touch screen monitor and transparent fire windows. In addition, because a separate collection container is provided, leakage liquid of hazardous material is prevented from being exposed to the outside, thus enhancing safety.

In the present invention, the storage containers are independently installed in the storage apparatus. Thus, even if a fire occurs in one storage container, the present invention can prevent the fire from affecting the adjacent storage containers. Moreover, each storage container has a system which can detect a fire and automatically extinguish it. Therefore, in a factory such as a semiconductor manufacturing factory, an injury to human or damage to equipment can be prevented.

In addition, hazardous material stored in each storage container can be minimized from being exposed to the air.

Furthermore, even if a small amount of hazardous material less than a dangerous level leaks, spontaneous combustion thereof is induced by air in the storage container or circulating air, so that leakage liquid of hazardous material can be eliminated.

If a relatively large amount of hazardous material leaks, a fire may occur. In the present invention, even if a fire occurs in the storage container, a fire sensor detects the fire and creates a signal such that nitrogen is supplied into the storage container, thus reducing the density of oxygen and extinguishing the fire.

Moreover, when a fire occurs in the storage container, a door of the storage container storing hazardous material therein is automatically closed. Thereby, the fire can be rapidly extinguished.

Although the preferred embodiment of the present invention has been disclosed for illustrative purposes, those skilled in the art will appreciate that various modifications, additions and substitutions are possible, without departing from the scope and spirit of the invention as disclosed in the accompanying claims.

What is claimed is:

1. An apparatus for storing hazardous material, comprising:

a plurality of storage containers each storing a hazardous material storage box containing hazardous material therein, the hazardous material storage box being extracted from or retracted into the storage container by transfer means;

a fire sensor provided in each of the storage containers to detect a fire occurring in the storage container;

a temperature sensor provided in each of the storage containers to sense a temperature in the storage container;

an injection nozzle provided in each of the storage containers, the injection nozzle injecting nitrogen into the storage container from a nitrogen supply unit when a fire is detected;

an outlet pipe connection passage and a flexible outlet pipe connection tube to exhaust gas from the storage containers; and a collecting container provided in a lower end of the apparatus to collect and store leakage liquid of hazardous material therein.

2. The apparatus as set forth in claim 1, wherein a lock and a transparent fireproof window are provided on each of the storage containers.

3. The apparatus as set forth in claim 1, wherein to prevent the hazardous material from leaking from the hazardous material storage box, the hazardous material storage box is configured such that a top plate is perpendicularly coupled to support plates by coupling bolts, and an inner reinforcing plate is attached to each of the support plates by welding, with a cable hole formed in each of the support plates so that an electric wire or a cable passes through the cable hole.

4. The apparatus as set forth in claim 1, wherein a ventilation port is provided in an outer wall of each of the storage containers so that gas is discharged from the storage container through the ventilation port, the ventilation port comprising:

a square frame;

one or more horizontal grid plates supported by the square frame, each of the horizontal grid plates having a plurality of horizontal ventilation slots; and one or more vertical grid plates supported by the square frame, each of the vertical grid plates having a plurality of vertical ventilation slots, wherein the horizontal grid plates and the vertical grid plates alternately overlap each other such that the vertical ventilation slots and the horizontal ventilation slots perpendicularly cross each other, thus forming a lattice structure.

5. The apparatus as set forth in claim 1, further comprising:

an outlet pipe through which gas is discharged from the storage containers;

a lock provided on an outer surface of each of the storage containers to prevent an access of an unauthorized person; and an air curtain device provided in each of the storage containers to isolate an interior of the storage container from an outside air when the storage container is opened or a fire occurs in the storage container, wherein electrical devices for temperature control, ventilation and fire extinguishment are installed in the storage containers, the electrical devices comprising a control unit, a power supply, an earth leakage breaker, a DC power supply unit, a programmable logic controller (PLC) and a relay.

6. The apparatus as set forth in claim 1, further comprising:

a door control cylinder and a solenoid valve connected to each of the storage containers, wherein when the fire sensor determines that a fire occurs in the storage container, the solenoid valve is turned on such that the nitrogen supply unit supplies nitrogen into the door control cylinder, when the fire sensor determines that the fire is extinguished in the storage container, the solenoid valve is turned off such that a nitrogen discharge path along which the nitrogen is discharged from the door control cylinder is formed, and the door control cylinder comprises: an inlet through which the nitrogen is supplied from the nitrogen supply unit into the door control cylinder; an outlet through which air is discharged outside of the door control cylinder; a cylinder rod rotatably coupled to a connection arm, the connection arm being rotatably coupled to a door of the storage container, the cylinder rod being operated by the nitrogen supplied into the door control cylinder; and a piston coupled to a corresponding end of the cylinder rod in the door control cylinder, wherein the inlet is formed in the door control cylinder at a side adjacent to the cylinder rod based on the piston, and the outlet is formed in the door control cylinder at a side opposite to the cylinder rod based on the piston.

* * * * *